United States Patent [19]

Hinterreiter

[11] Patent Number: 4,966,305

[45] Date of Patent: Oct. 30, 1990

[54] TABLET DISPENSER

[75] Inventor: Ignaz Hinterreiter, St. Valentin, Austria

[73] Assignee: Centromint Company Establishment, Vaduz, Liechtenstein

[21] Appl. No.: 240,598

[22] Filed: Sep. 6, 1988

[51] Int. Cl.[5] ..... B65D 83/04

[52] U.S. Cl. ..... 221/229; 221/279

[58] Field of Search ..... 221/229, 279, 280, 59; 453/49, 52, 54; 312/61, 71

[56] References Cited

U.S. PATENT DOCUMENTS 2,620,061 12/1952 Uxa ..... 221/229
3,425,595 2/1969 Shapira ..... 221/59 X
4,295,579 10/1981 Haas ..... 221/229

FOREIGN PATENT DOCUMENTS 0260250 3/1988 European Pat. Off. ..... 221/229

*Primary Examiner*—F. J. Bartuska

[57] ABSTRACT

A tablet dispenser has a sleeve and a magazine for holding the tablet stack. The magazine is guided in the sleeve and has an essentially U-shaped cross-section and a base connecting the limbs. For filling purposes, the magazine can be pushed partially out of the sleeve against the force of a spring arranged between the base of the magazine and a cup-like slide that is displaceable in the magazine and in the sleeve and acts as a plate spring. The slide is guided in the magazine to prevent complete tilting in the magazine and is provided with lateral projections, one of which passes through a slot arranged in the web of the magazine and engages a groove running in the longitudinal direction of the sleeve and the other of which engages a further longitudinal groove of the sleeve, which longitudinal grooves are at least partially closed at the push-out end of the sleeve and form stops for the projections of the slide. The projection of the slide that passes through the slot of the magazine is provided with a hammer-head, and a pin stop is arranged close to the base of the magazine, on the latter, and engages between two coils of the spring.

8 Claims, 4 Drawing Sheets

Figure 1:
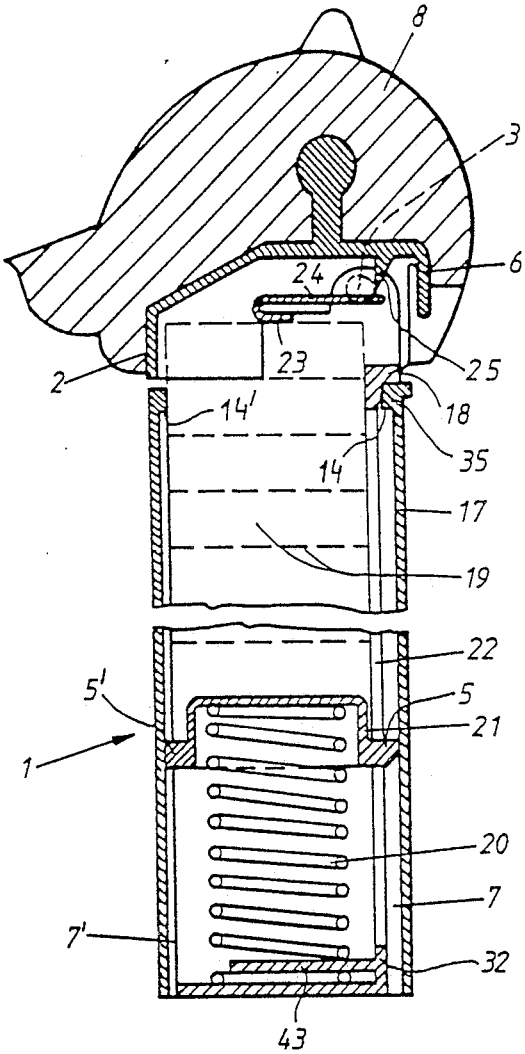

Fig. 2
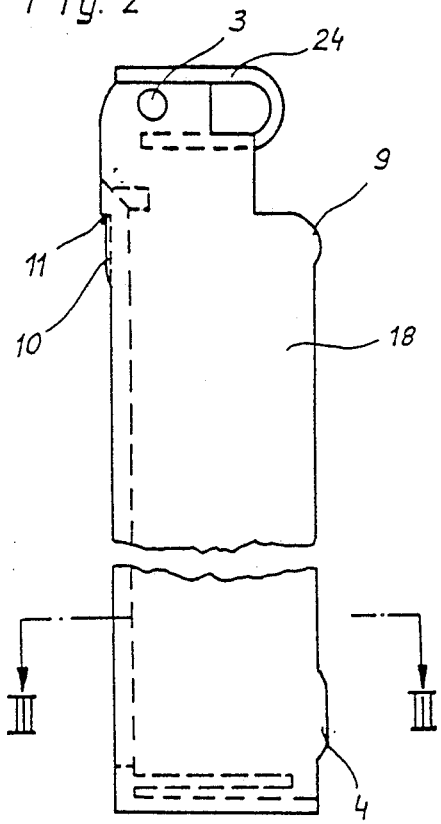
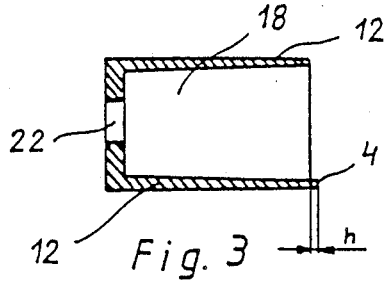
Fig. 3

TABLET DISPENSER

A tablet dispenser which has a sleeve and a magazine for holding the tablet stack, which magazine is guided in this sleeve and has an essentially U-shaped cross-section and a base connecting the limbs and, for filling purposes, can be pushed partially out of the sleeve against the force of a spring arranged between the base of the magazine and a cup-like slide which is displaceable in the magazine and in the sleeve and acts as a plate spring, the slide being guided in the magazine to prevent complete tilting in the said magazine and being provided with lateral projections, one of which passes through a slot arranged in the web of the magazine and engages a groove running in the longitudinal direction of the sleeve and the other projection engages a further longitudinal groove of the sleeve, which longitudinal grooves are at least partially closed at the push-out end of the sleeve and form stops for the projections of the slide. To avoid danger due to parts, such as, for example, the spring (20), jumping out, even during improper treatment of the tablet dispenser leading to at least partial destruction of the said dispenser, it is envisaged that the projection (5) of the slide (21), which projection passes through the slot (22) of the magazine (18), is provided with a hammer-head (40) and, preferably, a pin stop (43) which is arranged close to the base of the magazine (18), on the latter, engages between two coils of the spring (20).

Description

The invention relates to a tablet dispenser which has a sleeve and a magazine for holding the tablet stack, which magazine is guided in this sleeve and has an essentially U-shaped cross-section and a base connecting the limbs and, for filling purposes, can be pushed partially out of the sleeve against the force of a spring arranged between the base of the magazine and a cup-like slide which is displaceable in the magazine and in the sleeve and acts as a plate spring, the slide being guided in the magazine to prevent complete tilting in the said magazine and being provided with lateral projections, one of which passes through a slot arranged in the web of the magazine and engages a groove of the internal wall of the sleeve, which groove runs in the longitudinal direction of the sleeve, and the other projection engages a further longitudinal groove of the sleeve, which longitudinal grooves are at least partially closed at the push-out end of the sleeve and form stops for the projections of the slide.

Such a tablet dispenser has been disclosed, for example in Austrian Patent No. 362,073 which corresponds to U.S. Pat. No. 4,295,579 and has proven very suitable.

However, it has been found that when such a tablet dispenser is improperly used, for example when the magazine is pulled out, leading to partial destruction of the sleeve as a result of the stops or the projections of the slide being broken off, it is possible that the spring or the slide jumps out, which may in certain circumstances cause injuries.

It is the object of the invention to avoid danger to the user even when a tablet dispenser of the type mentioned at the outset, which is usually produced from plastic, is improperly used and in particular reliably to prevent the spring from jumping out.

This object is achieved, according to the invention, if the slide projection which passes through the slot of the magazine is provided with a hammer-head and, preferably, a pin stop arranged close to the base of the magazine, on the latter, engages between two coils of the spring.

These measures ensure that the slide, since it engages behind the web of the magazine with its hammer-head, can no longer jump out of the sleeve if the magazine is torn out forcibly. However, this also prevents the spring engaging the hollow prismatic slide from jumping out. The spring is additionally secured by the pin stop engaging between two coils of the spring.

To facilitate insertion of the slide into the magazine, it can be ensured that the lateral surfaces of the hammer-head approach one another toward its free end face and make an angle of, preferably, 30° with the axis running in the direction of the stem of the hammer-head. This permits the slot of the magazine web to be extended in a very simple manner by simply pressing the slide into the magazine at the open end of the latter.

According to a further feature of the invention, it is possible to ensure that the lower surface of the hammer-head, which surface faces the base of the magazine, slopes obliquely upward toward the free end face of the said hammer-head and preferably forms an angle of 45° with the contact plane of the slide. Consequently, the oblique lower surface of the hammer-head forms an abutting surface which makes it easier to press the magazine, together with the slide inserted into the latter, into the sleeve, the latter being extended, and the hammer-head snapping into the groove which is provided for the hammer-head in the sleeve and which is at least partially closed at the push-out end of the sleeve by means of a cross-bracket.

In order to center the slide in the sleeve and thus make it more difficult to pull out the slide and the magazine held by the latter in the sleeve, it is also possible to ensure that the groove base of every sleeve groove which holds a projection of the sleeve ascends in the region of the push-out end of the sleeve so that the internal distance between the opposite groove bases decreases toward the end of each groove, the angle of ascent preferably being 3°.

According to a further feature of the invention, it is possible to ensure that the sleeve possesses, in the region of its push-out end, expanding cams which extend from the two corner regions formed by the side walls of the sleeve, are arranged on the sleeve surface facing the inner web surface of the magazine and slope upward toward the interior of the sleeve and force apart the limbs of the magazine when the latter has been inserted.

This ensures that the limbs of the magazine, which is generally made of plastic and whose limbs therefore generally have a tendency to bend inward and hence to clamp the tablets, are forced outward in the region of the dispensing end of the tablet dispenser, with the result that clamping of the tablets and hence difficulties in dispensing the latter are avoided.

Figure 8:
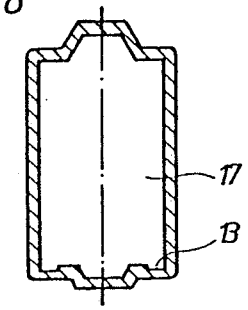
Figure 4:
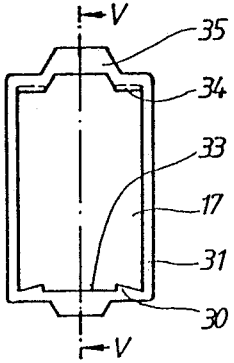
Figure 7:
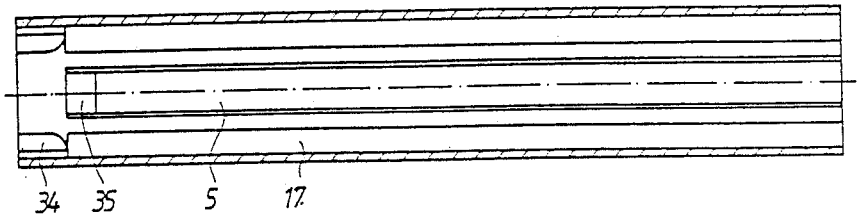
Figure 6:
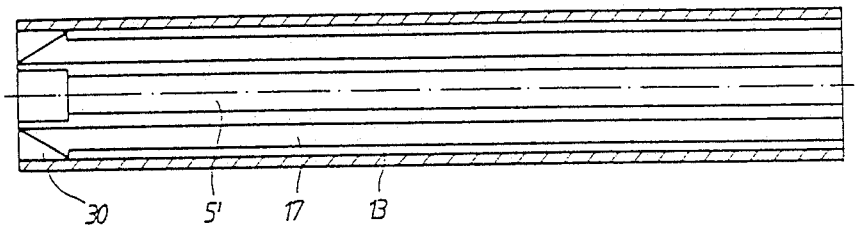
Figure 5:
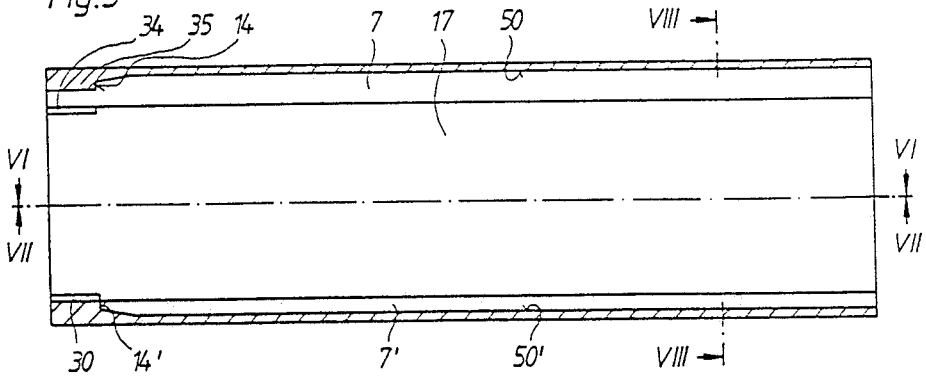

The invention is illustrated in more detail with reference to the drawings. FIG. 1 shows a section through a tablet dispenser according to the invention; FIG. 2 shows a side view of the magazine of a tablet dispenser according to FIG. 1; FIG. 3 shows a section through the magazine according to FIG. 2; FIG. 4 shows a plan view of the sleeve; FIG. 5 shows a section through the sleeve along the line V—V in FIG. 4; FIG. 6, 7 and 8 show sections through the sleeve along the lines VI—VI, VII—VII and VIII—VIII, respectively, in FIG.

Figure 9:
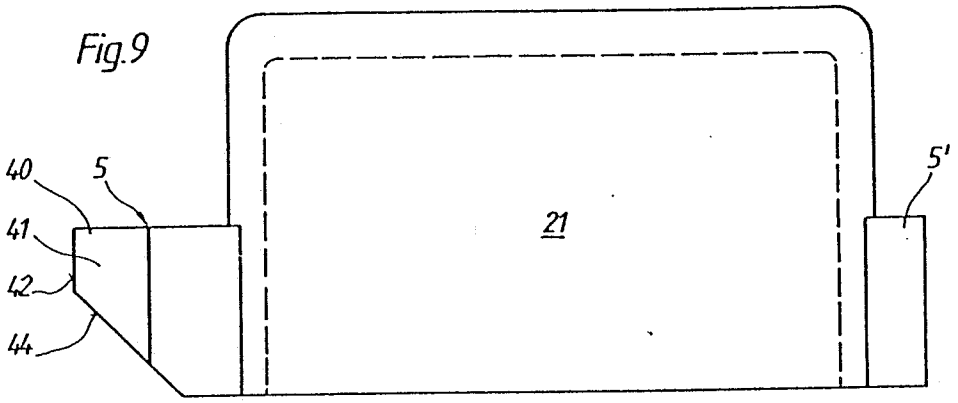
Figure 10:
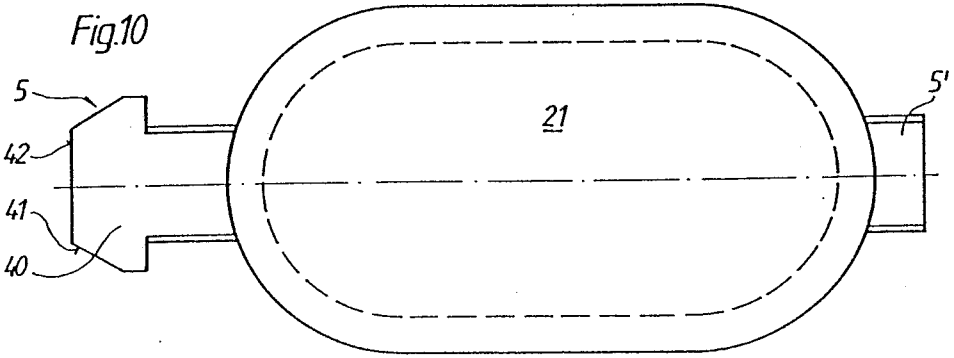

5; FIG. 9 shows a view of the slide and FIG. 10 shows a plan view of the slide.

The tablet dispenser 2 essentially consists of the sleeve 17, the magazine 18 which is axially displaceable inside the sleeve 17 and which holds the tablets 19 indicated by means of a dashed line, and the slide 21 which is subjected to a force by the spring 20 impresses the tablets 19 against the upper end or dispensing end of the tablet dispenser 1. The spring 20 is supported on the base of the magazine 18 which possesses, on its rear, a slot 22 through which a lug of the slide 21 passes and which is open continuously along its front to permit insertion of the stack of tablets when the magazine 18 is pulled upward. The lugs 5, 5' of the slide 21 engage the grooves 7, 7' of the sleeve 17, which terminate before the upper end of the sleeve 17.

At its upper end, the magazine 18, on the outside of whose side walls are formed the pins 3 engaging a hole in the lid part 2, has a bridge 23 connecting its side walls and provided with an extension 24 acting as a spring. A lug 25 formed on the inside of the lid part 2 is supported at its free end behind the axis of rotation determined by the pins 3 indicated by dashed lines, so that the lid part 2 is spring-loaded in the closing direction.

The tablets 19 are pressed upward by the slide 21 until the uppermost tablet rests against the bridge 23. If the lid is now rotated, the extension 6 of the lid part 2 comes into contact with the back of the tablet 19 and subsequently pushes the latter forward through the opening formed between the upper edge of the sleeve 17 of the tablet dispenser 1 and the lower edge of the lid part 2, so that the tablet can easily be removed. If the lid is released, it is turned back by the spring action of the extension 24 to the starting position shown, and the slide 21 pushes the remaining stack upward until the next tablet 19 rests against the bridge 23.

As shown in FIG. 2 and 3, the magazine 18, which is essentially U-shaped in cross-section, has wider parts 9, 10 which ensure that the magazine 18 is firmly held when inserted completely into the sleeve 17. Furthermore, a lug 11 is provided which prevents the magazine 18 from being pushed through the sleeve 17.

In the lower region of the magazine 17, the latter has a cam 4 formed on a limb or side wall 12. The slope of this cam 4 is in the form of a rounded surface. This cam 4 slides in one of the grooves 13 of the sleeve 17 (FIG. 8).

As shown in FIG. 6 and 7, the grooves 5 and 5' and the grooves 13 terminate before the upper end of the sleeve 17. Hence, if the magazine 18 is pushed upward out of the sleeve 17, the cam 4 of the magazine 18 runs to the end of a groove 13, with the result that, because of the rounding or the bevel of the cam 4, whose height h corresponds to the play provided between the region of the magazine 18 adjacent to the cam 4 and the region of the sleeve 17 adjacent to the end of the groove 13, the said cam emerges at least partially from the groove 13, resulting in at least a keying fit if not a press fit between the magazine and the sleeve when the former has been pulled out of the sleeve 17 to such an extent that the cam 4 has run to the end of the groove or has been pulled at least partially out of the groove 13. This prevents the magazine 18 from being pressed into the sleeve 17 again by the spring 20, which is supported on the base of the magazine 18 and, when the magazine is empty, via the slide 21 and its extensions 5, 5' against the sleeve 17 or its stops 14, 14' formed by the axial limitations of the grooves 5, 5'.

In the examples shown, the release for the cam 4 is in the form of a groove 12. However, this is in no way essential and it is also possible to provide a release which extends over the entire width of the sleeve 17, and it would of course be necessary to retain the grooves 5, 5' and accordingly to make the lugs 5, 5' of the slide 21 protrude further. Like the grooves 13, such a release would also have to terminate before one end of the sleeve or it would be necessary to provide an appropriate, inward-projecting lug at this point.

As shown in FIG. 4 and 6, the region of the upper or push-out end of the sleeve 17 is provided with expanding cams 30 which slope upward from the corners formed by the side walls 31 and the inner surface 33 which faces away from the web 32 of the magazine 18 inserted into the sleeve 17, and simultaneously slopes upward from the corners toward the center of the cross-section of the sleeve. These expanding cams 30 interact with the wider parts 16 of the magazine, which is usually produced from relatively resilient plastic. This ensures that the limbs or the side walls 12 of the magazine 18 are forced apart when the magazine is fully inserted into the sleeve 17 and clamping of the tablets 19 in the dispensing region is prevented.

The wider parts 10 of the magazine 18 come to rest against projections 34 (FIG. 4, 7) of the sleeve when the magazine 18 is fully inserted into the sleeve 17, thus ensuring that the magazine 18 is securely held in the sleeve 17, even when the magazine is full.

As shown clearly in FIG. 1, 5 and 8, the grooves 7, 7' of the sleeve have different depths, the groove 7 being only partially closed at its upper or push-out end by means of a catch 35 which forms the stop 14 for a lug 5 of the slide 21.

As shown in FIG. 1, 9 and 10, the slide 21 is cup-like and holds the end region of the spring 20 in its interior. The lug 5 of the slide, which, as shown in FIG. 10, has at its free end a hammer-head 40 whose lateral surfaces 41 converge toward the free end face 42, passes through the slot 22 of the web 32 of the magazine 18 and, with its hammer-head 40, engages the groove 7 of the sleeve 17. The lateral surfaces 41 of the hammer-head make an angle of about 30° with the longitudinal central plane of the lug 5 or its stem connecting the hammer-head 40 to the slide.

The slide 21 is installed in the magazine 18 simply by inserting the spring 21 into the magazine 18, the pin stop 43 which projects from the web 32 toward the open end of the magazine penetrating between two coils of the spring 20 and securing the latter. Thereafter, the slide 21 is inverted over the free end of the spring 20, and the lug 5 of the slide is pressed through the slot 22 of the web 32 of the magazine 18, the slot 22 being expanded by the oblique lateral surfaces 41 of the hammer-head 40.

After the magazine 18 has been inserted into the sleeve 17, the slide 21 is inclined by pressing on its side nearer the lug 5 to such an extent that the lug 5 comes to rest under the stop 14' of the sleeve 17, after which the magazine 18 is fully inserted into the sleeve 17. This results in an expansion of the sleeve 17 through penetration of the projecting lug 5 of the slide 21 until the lug snaps in under the catch 35. This expansion of the sleeve 17, which is usually made of plastic, is facilitated by the lower surface 44 of the lug 5, which surface is inclined upward toward the free end face 42, at about 45° to the contact surface of the slide, or the hammer-head 40 of the said lug 5.

After complete insertion of the magazine 18 together with the slide 21, the slide, because of its dimensions, in particular its height, can no longer be tilted in the magazine 18 or the sleeve 17 sufficiently to permit the lug 5 or 5' from sliding out of the relevant grooves 7, 7' restricted by the stops 14, 14'.

Complete separation of magazine 18 and sleeve 17 is possible only with damage to, or destruction of, the sleeve 17, which is expediently made of a more brittle material than the slide 21, and the stops 14, 14' or the catch 35 must be broken off.

In such a case, however, the spring 20 and the slide 21 remain in the magazine 18 since the lug 5 of the slide 21 with its hammer-head engages behind the web 32 of the magazine and therefore remains connected to the magazine. However, this also prevents the spring 20 from jumping out, since the latter is held by the slide and its other end is virtually held between the base of the magazine 18 and the pin stop 43. Thus, if the tablet dispenser is improperly used, the spring 20 can merely bend out of the magazine 18, so that danger from the pointed ends of the spring is avoided.

In order to center the slide 21 in the region of the push-out end of the sleeve 17 in the space bordered by the sleeve and the magazine, and thus to make tilting of the slide 21 more difficult, the base 50, 50' of the grooves 7, 7' inclines slightly upward in the region after the catch 35 and the stop 14', the slope being about 3°.

I claim:

1. A tablet dispenser which has a sleeve and a magazine for holding the tablet stack, which magazine is guided in the sleeve and has an essentially U-shaped cross-section and a base connecting its limbs and, for filling purposes, can be pushed partially out of the sleeve against the force of a spring arranged between the base of the magazine and a cup-like slide that is displaceable in the magazine and in the sleeve and acts as a plate spring, the slide being guided in the magazine to prevent complete tilting in the magazine and being provided with lateral projections, one of which passes through a slot arranged in a web of the magazine and engages a groove running in the longitudinal direction of the sleeve and the other of which engages another longitudinal groove of the sleeve, which longitudinal grooves are at least partially closed at the push-out end of the sleeve and form stops for the projections of the slide, wherein the projection (5) of the slide (21), that passes through the slot (22) of the magazine (18) is provided with a hammer-head (40); a pin stop (43) is arranged close to the base of the magazine (18) on the latter and engages between two coils of the spring (20); and a base (50, 50') of each groove (7, 7') of the sleeve (17) which holds a projection (5, 5') of the slide (21) slopes upward in the region of its push-out end, so that the internal distance between the opposite bases (50, 50') of the grooves decreases toward the end of each groove (7, 7').

2. A tablet dispenser as claimed in claim 1, wherein the hammer-head has lateral surfaces and a stem, and the lateral surfaces (41) of the hammer-head (40) approach one another toward a free end face (42) thereon and make an angle of about 30 degrees with an axis running in the direction of the stem of the hammer-head (40).

3. A tablet dispenser which has a sleeve and a magazine for holding the tablet stack, which magazine is guided in the sleeve and has an essentially U-shaped cross-section and a base connecting its limbs and, for filling purposes, can be pushed partially out of the sleeve against the force of a spring arranged between the base of the magazine and a cup-like slide which is displaceable in the magazine and in the sleeve and acts as a plate spring, the slide being guided in the magazine to prevent complete tilting in the magazine and being provided with lateral projections, one of which passes through a slot arranged in a web of the magazine and engages a groove running in the longitudinal direction of the sleeve and another of which engages another longitudinal groove of the sleeve, which longitudinal grooves are at least partially closed at the push-out end of the sleeve and form stops for the projections of the slide, wherein the projection (5) of the slide (21) that passes through the slot (22) of the magazine (18) is provided with a hammer-head (40); a pin stop (43) is arranged close to the base of the magazine (18) on the latter and engages between two coils of the spring (20); the side walls of the magazine possess in a region which can last be inserted into the sleeve, projections which extend the side walls toward their free ends; and the sleeve (17) possesses, in the region of its push-out end, expanding lugs (30) which extend from two corner regions formed by the side walls (31) of the sleeve (17), are arranged on a surface (33) of the sleeve (17) facing an inner web surface of the magazine (18), slope upward toward the interior of the sleeve (17) and push apart the side walls (12) of the magazine (18) when the latter has been inserted.

4. A tablet dispenser as claimed in claim 1, 3 or 2, wherein a lower surface (44) of the hammer-head (40), which surface faces toward the base of the magazine (18), is inclined obliquely upward toward a free end face (42) on the hammerhead and makes an angle of about 45 degrees with a contact plane of the slide (21).

5. A tablet dispenser as claimed in claim 3, wherein the base (50, 50') of each groove (7, 7') of the sleeve (17) which holds a projection (5, 5') of the slide (21) slopes upward in the region of its push-out end, so that the internal distance between the opposite bases (50, 50') of the grooves decreases toward the end of each groove (7, 7').

6. A tablet dispenser as claimed in one of claims 1 or 3, wherein the hammer-head has substantially flat lateral surfaces and a stem; the substantially flat lateral surfaces (41) of the hammer-head (40) approach one another toward a free end face (42) thereon and make an angle of about 30 degrees with an axis running in the direction of the stem of the hammer-head (40); the free end face (42) has a substantially flat contact area to contact the longitudinal groove (7) in the sleeve (17); and the stem has a width adequate to provide substantial stability in operation.

7. A tablet dispenser as claimed in claim 1 or 3, wherein an upper surface of the hammer-head is substantially flat to fit flat against projections (14) on the magazine and sleeve in the region of its push-out end; and a lower surface (44) of the hammer-head (40) faces toward the base of the magazine (18), is inclined obliquely upward toward a free end face (42) on the hammer-head and makes an angle of about 45 degrees with a contact plane of the slide (21).

8. A tablet dispenser as claimed in claim 5, wherein the slope of each groove (7, 7') of the sleeve (17) is about 3 degrees.

* * * * *